US005727868A

United States Patent [19]

Sharma

[11] Patent Number: 5,727,868

[45] Date of Patent: Mar. 17, 1998

[54] WALL MOUNTED BATTERY OPERATED, FLUORESCENT ILLUMINATING DEVICE

[76] Inventor: Murari Sharma, 15315 Chinaberry St., Gaithersburg, Md. 20878

[21] Appl. No.: 550,830

[22] Filed: Oct. 31, 1995

[51] Int. Cl.[6] ..... F21S 9/02; F21S 3/00; F21S 3/02

[52] U.S. Cl. ..... 362/147; 362/217; 362/419; 362/194; 362/195

[58] Field of Search ..... 362/125, 147, 362/191, 194, 195, 198, 217, 260, 419, 432; 40/715

[56] References Cited

U.S. PATENT DOCUMENTS

| | | | |
|---|---|---|---|
| D. 312,703 | 12/1990 | Muller et al. | D26/92 |
| 1,561,543 | 2/1925 | Jewson | 362/260 |
| 3,307,026 | 2/1967 | Kramer | D26/62 |
| 3,331,958 | 7/1967 | Adler . | |
| 3,475,603 | 10/1969 | Gheno | 362/183 |
| 3,723,720 | 3/1973 | Schmidt et al. | 362/183 |
| 3,786,245 | 1/1974 | Cincotta et al. | 362/183 |
| 4,268,894 | 5/1981 | Bartunek | 362/158 |
| 5,032,958 | 7/1991 | Harwood | 362/217 |
| 5,136,477 | 8/1992 | Lemmey | 362/419 |
| 5,165,783 | 11/1992 | Barron, Sr. | 362/253 |
| 5,303,127 | 4/1994 | Kosann | 362/296 |
| 5,491,615 | 2/1996 | Nichols | 362/147 |

OTHER PUBLICATIONS

Exposures Catalog Spring 1995, page 20. *C. Rechargeable Picture Lamp* .

*Primary Examiner*—James C. Yeung
*Assistant Examiner*—Matthew Spark

[57] ABSTRACT

A framed picture illuminating device for mounting on the wall above the picture. The device utilizes a fluorescent light tube to produce uniform lighting and is powered by batteries which eliminates the requirement of electrical outlets and the spectacle of exposed electrical cords extending down the wall. The device is composed of a base, a stem and a reflector. The base houses the batteries and the electronic circuit that converts the direct current from the batteries to the alternating current required to power the fluorescent light tube. The base is configured to be mounted on a wall above a framed picture and present smooth, clean lines resulting in an appealing look.

15 Claims, 6 Drawing Sheets

WALL MOUNTED BATTERY OPERATED, FLUORESCENT ILLUMINATING DEVICE

BACKGROUND OF THE INVENTION

The present invention relates to an illuminating device used for lighting artwork such as paintings, photographs, tapestries, or for lighting bookcases or walls. More particularly, the present invention is a fluorescent picture lamp that is powered by batteries.

Heretofore, varied picture lamps have been proposed, including ones that use fluorescent light tubes to attain a more uniform lighting of the picture and to cast a light whose color attributes are closer to the color attributes of natural sunlight than from an incandescent light. The more uniform lighting achieved by the use of a fluorescent light tube is due to the light being emitted from numerous points across the length of the bulb instead of from a single point source as is the case in an incandescent light. Fluorescent light tubes are also advantageous in that they illuminate the picture or artwork using an efficient lighting source that produces very little heat compared to incandescent lighting, thus being much less harmful to the artwork than an incandescent light exemplified by U.S. Pat. No. 3,307,026 (Kramer); U.S. Pat. No. 3,475,603 (Gheno); U.S. Pat. No. 3,773,720 (Schmidt); U.S. Pat. No. 3,786,245 (Cincotta); D312,703 (Muller); and Exposures Catalog, Spring 1995, Page 20.

Fluorescent picture lamps that have been proposed heretofore (see U.S. Pat. No. 5,165,783 (Barron, Sr.) and U.S. Pat. No. 5,303,127 (Kosann)) are powered by conventional household electricity, along with a cord to be connected to the household electric line, or by being plugged into a household electric socket. The unsightliness of the power cord leaves the user with the choice of either masking the cord by covering it, which requires effort in installation and leaves a cord cover visible; or, the choice of going through the lengthy and difficult installation process of routing the wire behind the wall and also connecting the power to the cord from behind the wall.

Fluorescent light tubes powered by either conventional batteries or rechargeable batteries (see U.S. Pat. No. 3,331,958 (Adler) and U.S. Pat. No. 4,268,894 (Bartunek)) have also been proposed due to the much greater efficiency of the fluorescent lamp in applications that demand more light and more life from the use of a limited power source. However, these lamps have been made and configured for use as emergency lights or other uses where conventional household electricity is not available, such as in a light to be used while camping, and their configuration does not lend itself to the lighting of pictures.

A fluorescent picture lamp has also been proposed heretofore (see Great Britain Patent 1,561,543 (Jewson)), that is powered by batteries, but this construction is configured to be mounted to the picture frame, from the back of the picture frame. This configuration has some distinct disadvantages. One disadvantage is that it increases the weight of the picture frame significantly, especially with the batteries installed. The amount of weight on a picture frame caused by such a configuration may make the method required for hanging the picture to be much more difficult, in that the supporting arrangements for the picture and the light will need to be strengthened. A second disadvantage is due to the method of securing this configuration to a picture frame being by screwing it to the picture frame. In the case of a wooden picture frame, this method can breach the integrity of the wood. Therefore, in the case of a wooden frame, this configuration is not desirable because of the expense of wooden frames. In the case of a metal picture frame, screwing into the metal becomes a very difficult task. Tools, other than a simple drill and screwdriver, may be required. Many metal picture frames are made of thin or extruded metal sheet, thereby not having enough surface area from the back to retain a screw, making it impossible to use the picture frame method for installation. Even in the case of some wooden picture frames, the same problem may arise, if the wooden picture frame is thin. Thus, this configuration is of limited use, whereby the user either cannot use it or will be limited in his/her choice of frames. A third disadvantage of the prior configuration is that because the batteries must be received in a box that is hidden behind the picture, the picture must be hung on the wall with an at least approximately 1.5 inch gap between the wall and the picture frame. This gap causes for a distinct decrease in the aesthetic appeal of a picture that utilizes such a picture lamp.

By mounting the picture lamp on the wall, above the picture frame, as in the present invention, it is easy to install the picture lamp in virtually any home or office, because there are a variety of easy methods of installing screws in various walls; the present invention further does not increase the weight of the picture and picture frame and it does not compromise the integrity of the picture frame. In addition to being easy to install, if the picture lamp is moved, walls are easy to patch and repair and wall repairs are easily accomplished by the homeowner.

SUMMARY OF THE INVENTION

It is an object of the present invention to provide a picture lamp which at one time provides even illumination of artwork while providing very little heat on the same, and is efficiently powered by batteries or rechargeable batteries, and can be easily mounted to the wall above the artwork.

It is also an object of the present invention to provide a picture lamp that illuminates artwork in the color temperature that is close to sunlight and lights the picture in closer to the same kind of color temperature it was painted in and was intended to be viewed in.

Another object of the present invention is to provide a picture lamp that mounts to a wall above a picture. The installation can be accomplished with ease requiring only screws that are anchored into a wall using a hand tap and a screwdriver.

It is a further object of the present invention to provide a picture lamp that is easy to manufacture and operate.

Yet another object of the present invention is to provide a picture lamp where user replaceable parts, namely the batteries and the fluorescent light tube, are readily available at low cost. Both the batteries (or rechargeable batteries) and the fluorescent light tube are readily and inexpensively available at hardware and other stores.

One more object of the present invention is to provide a picture lamp where the user replaceable parts, namely the batteries or rechargeable batteries, and the fluorescent light tube are easily replaced by the user, without the need for any tools. This is achieved by using a cover on the base of the invention that houses the batteries that is designed to slide off without the removal of screws or other fastening devices while still having the capability to "clamp" to the stem of the invention through the use of a hidden spring mechanism when the cover is pushed back on to the base, and thus have the capability of being retained with the base and not shake loose due to vibrations or other common household perturbations. This cover is also configured out of a single piece of stamped, extruded or molded material, making it very sleek and aesthetically pleasing. The fluorescent tube light is similarly able to slide into appropriate sockets, and retained in the sockets by simply twisting the fluorescent light tube.

The objects of the invention are achieved by the provision of a picture lamp which is comprised of a base, a stem and a reflector. The base houses the batteries or rechargeable batteries, along with the electronic circuit that converts the direct current from the batteries to alternating current that is required to power a fluorescent light tube. This current is then transferred to the reflector in wires that extend through the stem. The fluorescent light tube is housed in the reflector which is attached to the stem in a manner that positions the light at an angle whereby hanging artwork can be illuminated.

The entire invention can be easily constructed of stamped, extruded or molded material and is provided with all of the features for placement necessary to illuminate hanging artwork.

DESCRIPTION OF THE PREFERRED EMBODIMENT

Figure 1:
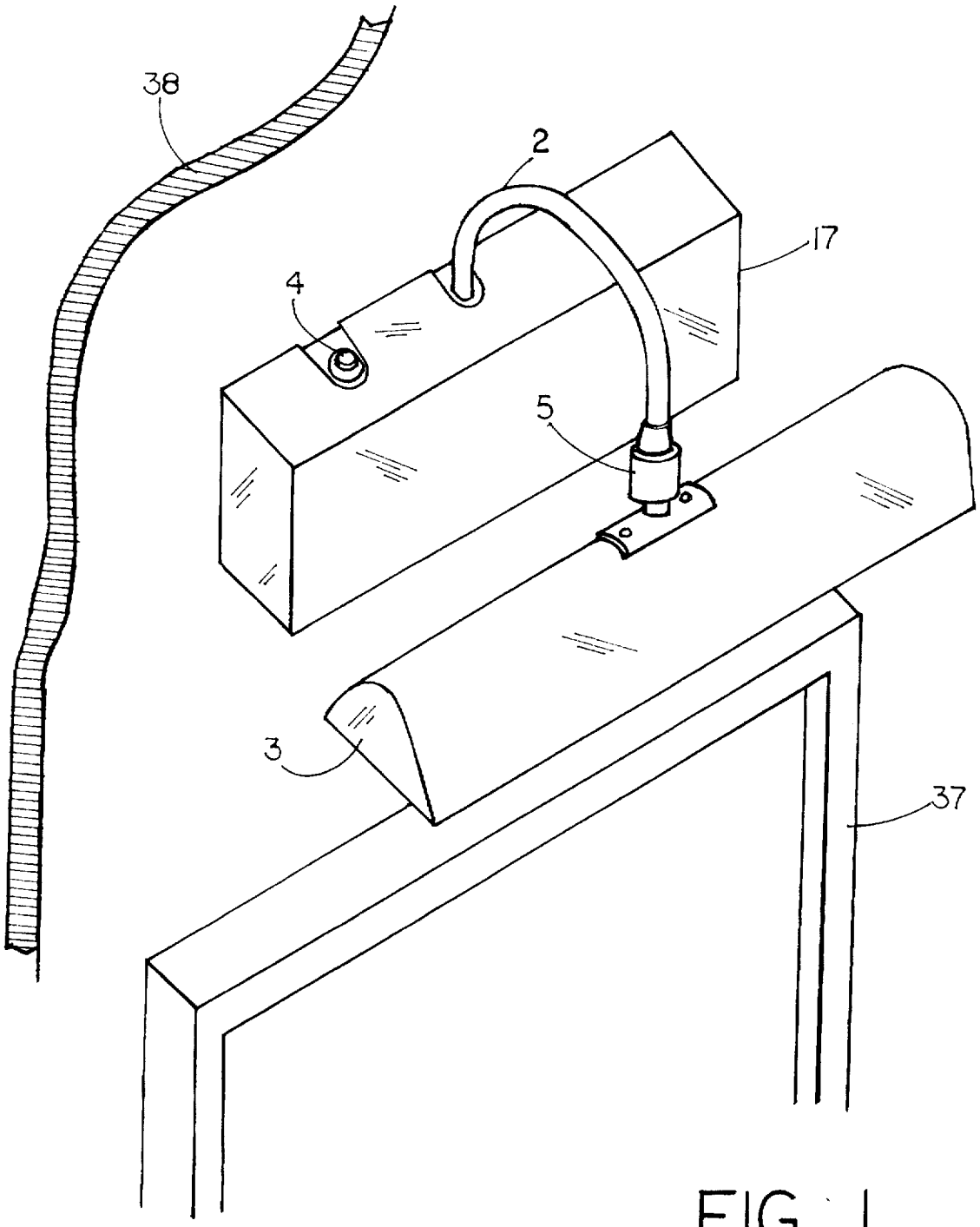
FIG. 1 is an perspective view of the assembled picture lamp.

Referring to FIG. 1, the picture lamp consists of a base I of generally rectangular shape that houses the electronics and batteries, a curved tubular stem 2 that acts to provide a desirable positioning of the reflector 3 over a picture 37, when the base 1 is mounted on a wall 38 above the picture 37. The stem 2 also acts as a conduit for the wires that lead from the base I to the reflector 3. The picture lamp is operated by a switch 4 of a simple on-off type and the reflector 3 can be further positioned for an optimum angle of light delivery to the picture 37 by adjustment of a swivel adjustment using a universal tilt mechanism 5.

Figure 2:
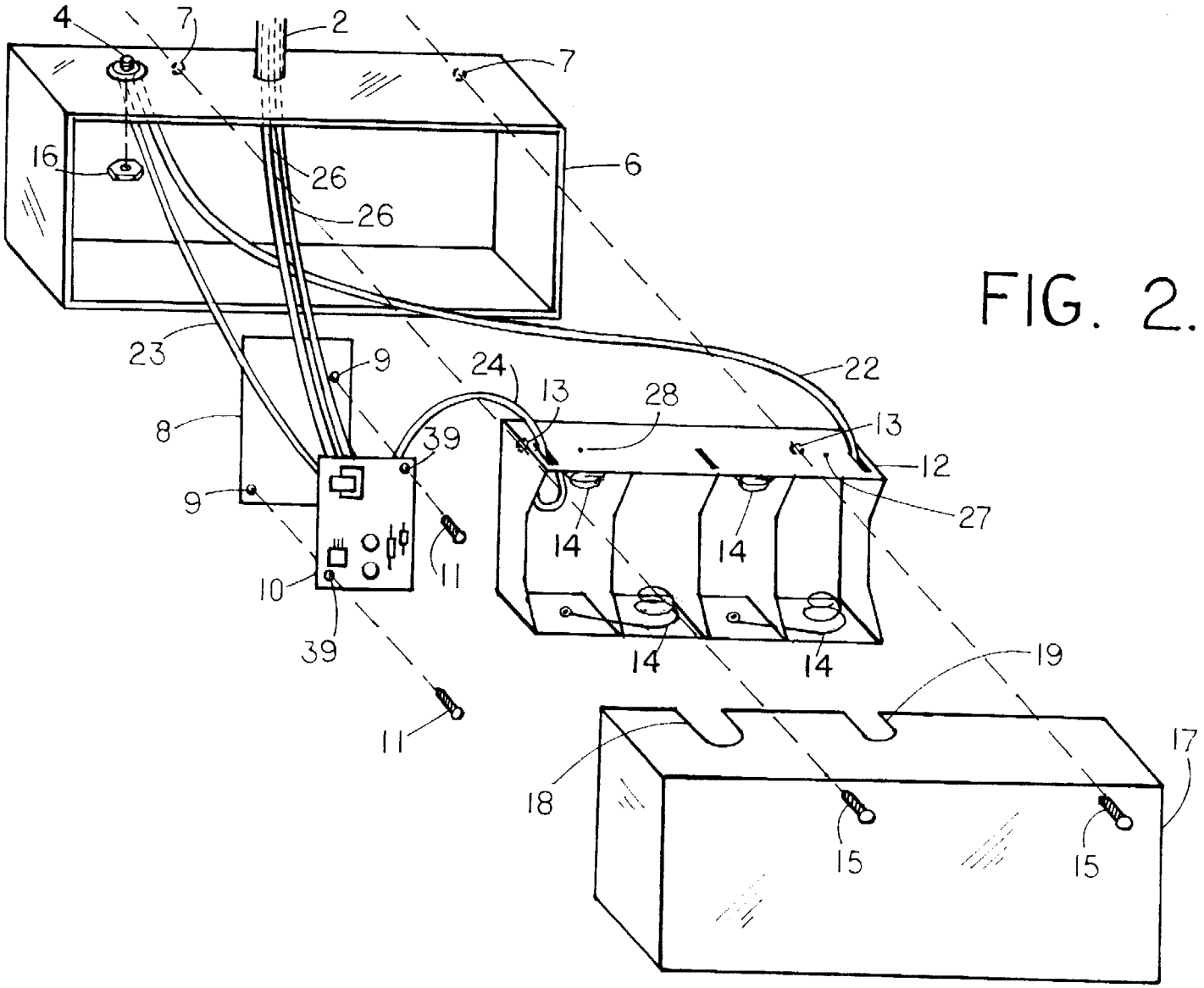
FIG. 2 is an exploded view showing all parts referred to in the description of the base of the picture lamp.

Referring to FIG. 2, the base 1 consists of an inside casing 6 that is generally box-shaped with the front being open. It has holes 7 drilled through the back to allow the screws 15 that mount the said picture lamp to the wall to pass therethrough. On one side wall of the inside casing 6 is mounted the switch 4 and the stem 2. The switch 4 is mounted by means of passing it through a hole in the wall of the inside casing 6 and tightened into place using a nut 16 to tighten it from the inside of the inside casing 6. The stem 2 is put through a hole in the inside casing 6 and welded or glued into place.

A generally rectangular shaped sheet of insulating material 8 is glued to the back of the inside casing 6. The electronic circuit card 10 is screwed to the insulating sheet 8 by passing two screws 11 through the holes 39 in the electronic circuit card 10 into the threaded holes 9 in the sheet of insulating material 8.

The battery holder 12 is designed to hold batteries in place by spring like contacts 14. The battery holder 12 can be made of extruded or molded material. The battery holder 12 has holes 13 in the back to allow the screws 15 that mount the picture lamp to the wall to pass therethrough. The battery holder 12 is also glued to the inside of the casing 6.

A positive current bearing wire 22 leads from the positive battery holder terminal 27 to the switch 4. A wire 23 leads from the switch 4 to the positive input terminal of the electronic circuit card 10. A ground wire 24 leads from the negative terminal 28 of the battery holder 12 to the negative input terminal on the electronic circuit card 10. Two wires 26 lead from the outputs of the electronic circuit card 10, are guided through the stem 2, and are connected to the two sockets 35 that hold and provide electrical contact to the fluorescent tube light 36.

The cover 17 of the housing 1 is also box-shaped, and open at the back. The cover 17 is slightly larger than the inside casing 6, so as to fit over the inside casing 6. It can be manufactured of stamped, extruded or molded material and has a semicircular notch 18 to allow for the presence of the switch 4 and also has a similar semicircular notch 19 to allow for the presence of the stem 2. The cover 17 is held in position by making the cover 17 close in size to the inside casing 6. The cover 17 is thus large enough to fit over the inside casing 6, but by keeping the tolerance small, a friction fit is achieved.

Figure 3A:
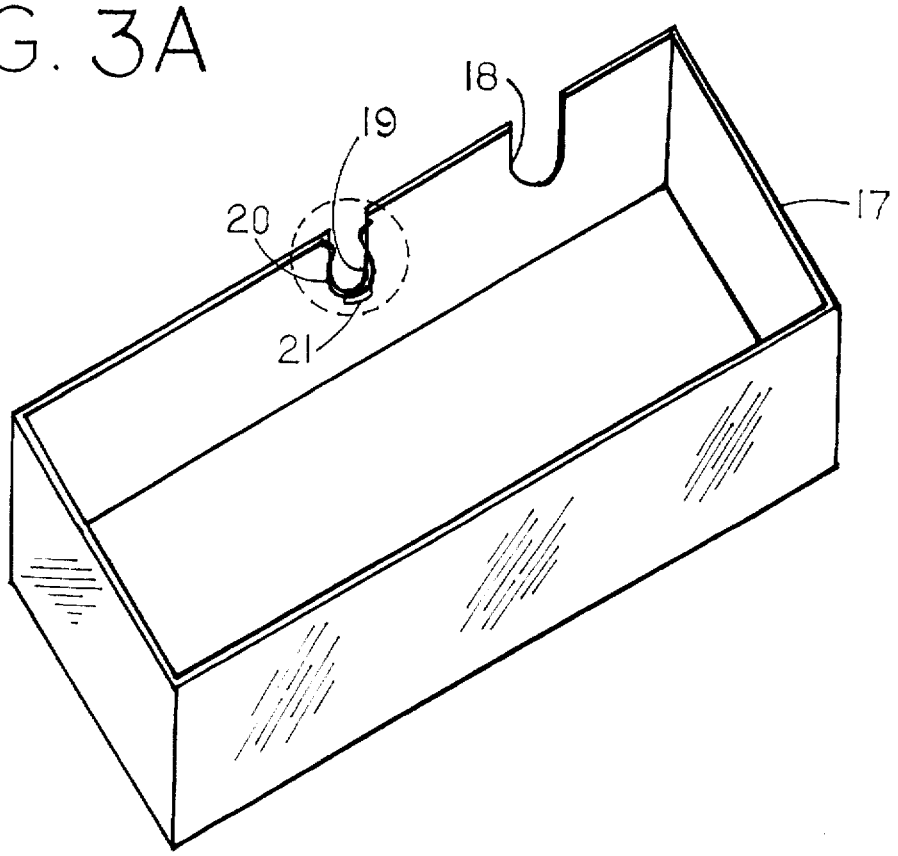
FIG. 3*a* is a plan view showing the cover of the base of the picture lamp.
Figure 3B:
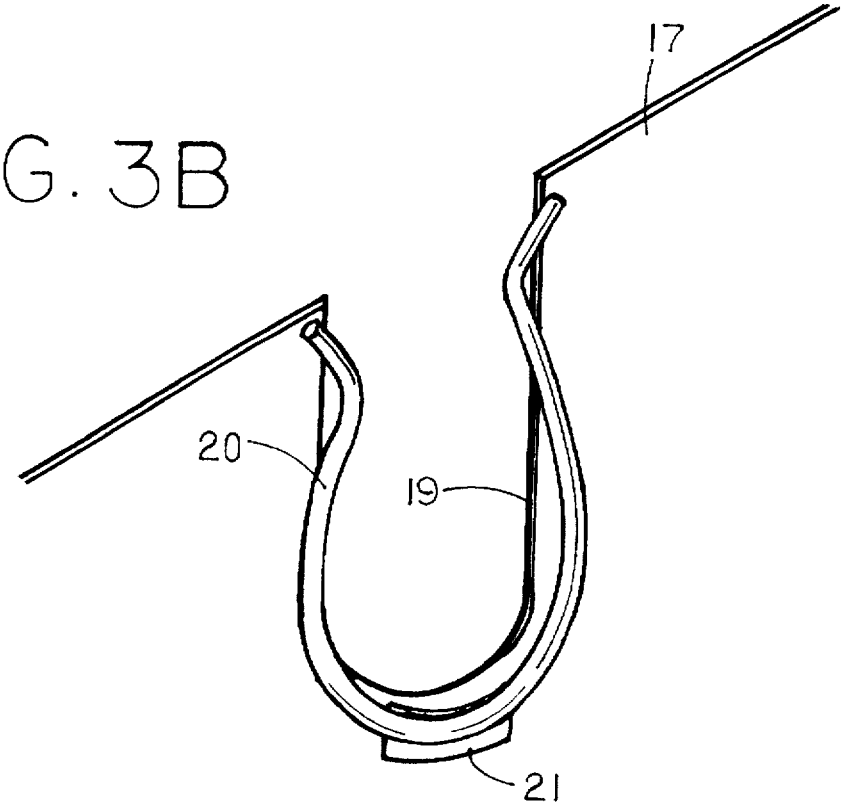
FIG. 3*b* is a fragmentary view of the cover showing the hidden spring mechanism.

Referring to FIG. 3, to further supplement or substitute for the friction fit of the cover 17, a spring clip 20 made of material that has resilient properties is fitted onto the underside of the cover 17. The diameter of the spring clip 20 is slightly larger than the diameter of the notch 19. The spring clip 20 is held to the cover by welding or gluing. Thus, when the cover 17 is pushed back onto the inner casing 6, the spring clip 20 will snap in over the stem 2 and cause the cover 17 to be held to the stem 2.

Figure 4:
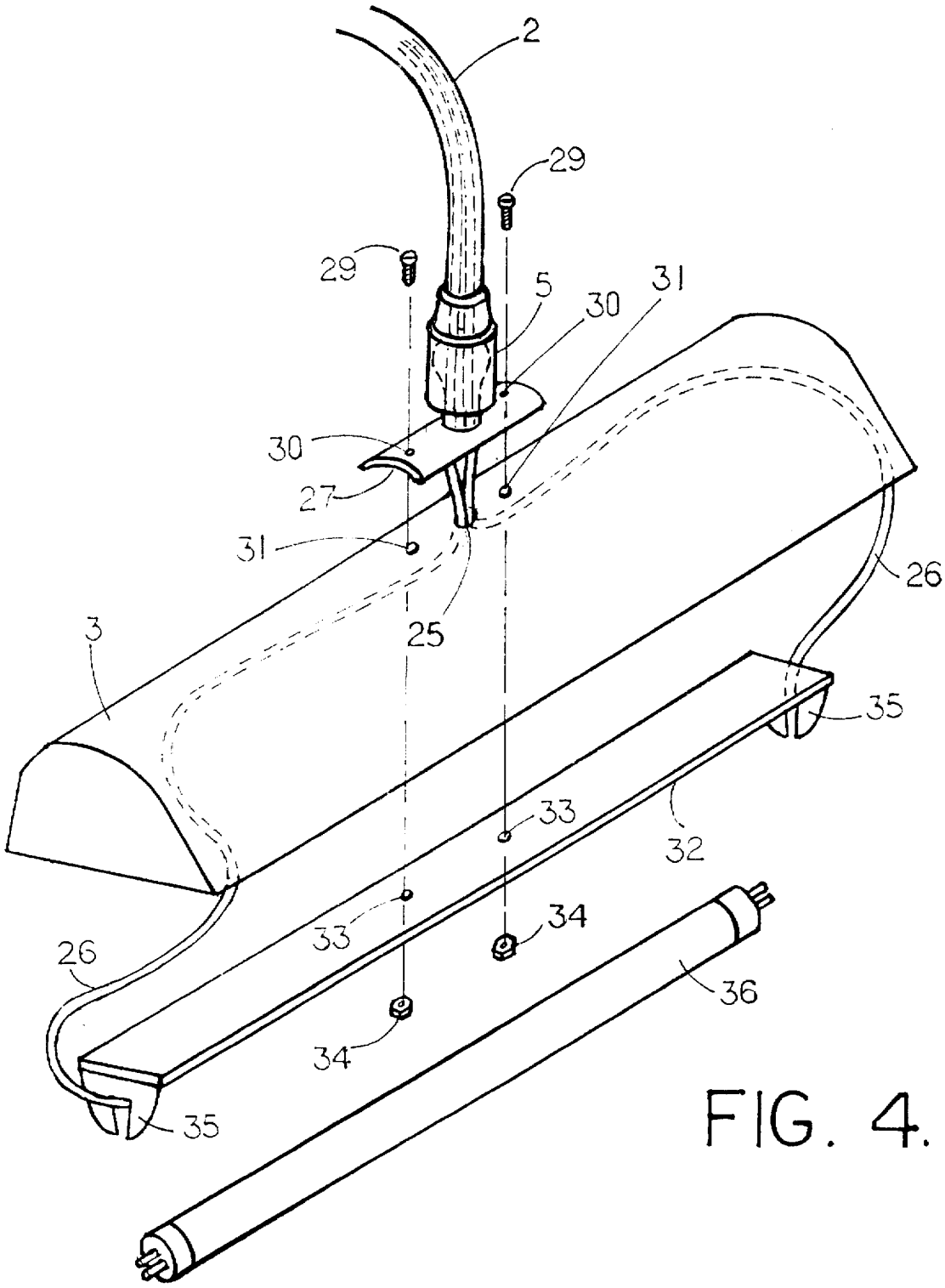
FIG. 4 is an exploded view showing all parts referred to in the description of the reflector of the picture lamp.

Referring to FIG. 4, the stem 2 connects to a slightly curved flange 27 by the universal tilt mechanism. The flange 27 can be made of stamped, extruded or molded material. The reflector 3 is also made of stamped, extruded or molded material and is of semicircular shape in the preferred embodiment. A bracket 32 is fitted on to the reflector 3. The bracket 32 houses, on either end, a socket 37 that holds and provides electrical contact to the fluorescent light tube 36. The assembly of the flange 27, the reflector 3, and the bracket 32 are held together by screws 29 that go through holes 30 in the flange 27, holes 31 in the reflector 3, and holes 33 in the bracket 32, and tightened by nuts 34 from the underside of the bracket 32. The sockets 35 are held on to the bracket 32 by glue. The wires 26 from the output of the electronic circuit are connected to the sockets 35. The fluorescent light tube 36 fits into the sockets 35 through grooves in the sockets 35 and then the fluorescent light tube 36 is twisted to be held in place by and to ensure electrical contact with the sockets 35.

Figure 5:
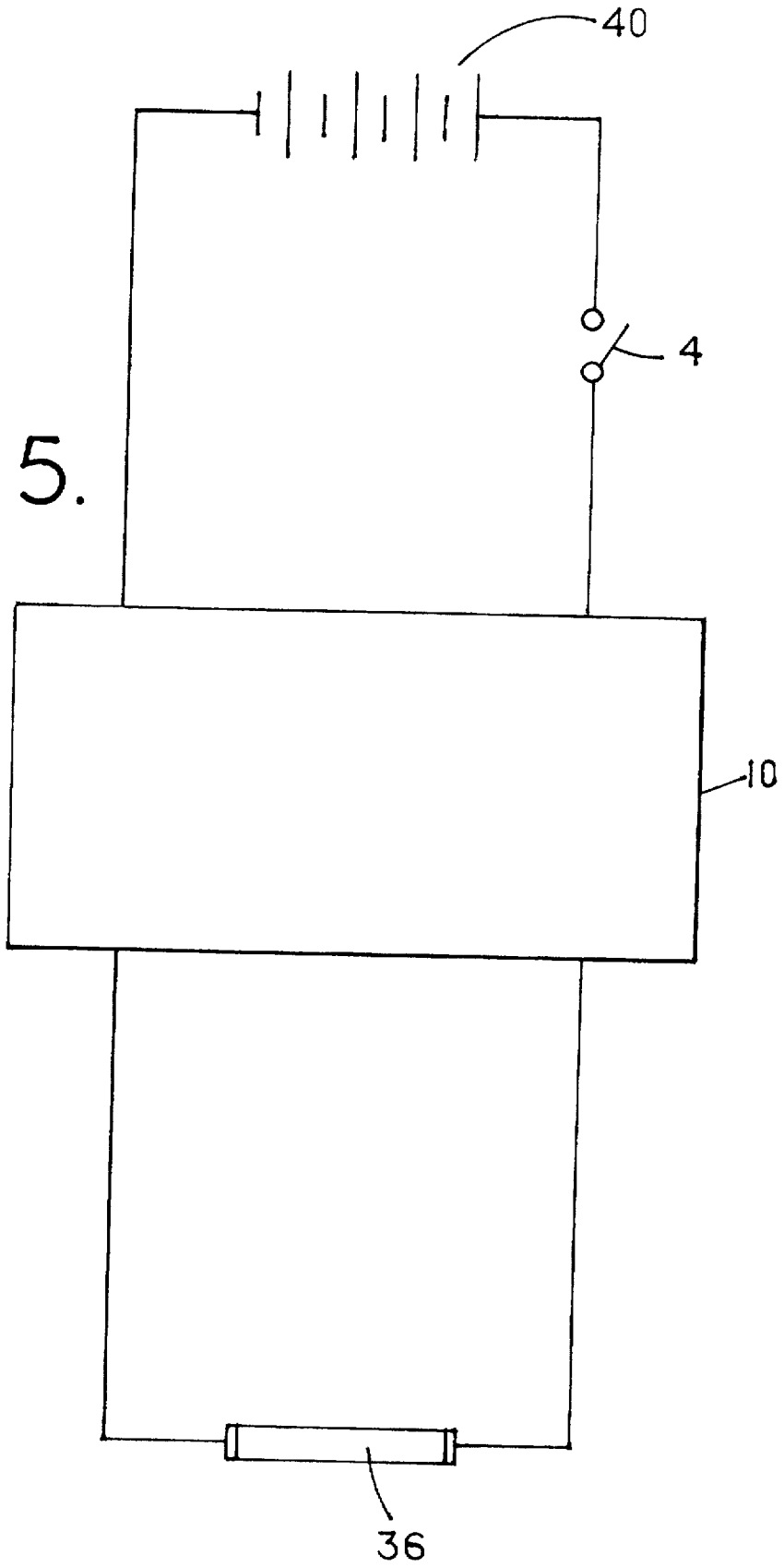
FIG. 5 is a circuit diagram of the picture lamp.

Referring to FIG. 5, the electrical circuit is comprised of a set of batteries 40 of conventional or rechargeable type where the positive output of the batteries 40 is connected to the switch 4. From the switch 4 is a connection to the positive input on the circuit card 10. The output of the circuit card 10 leads to the fluorescent light tube 36. The negative input of the circuit card 10 is connected to the negative input of the batteries 40 to complete the circuit.

Figure 6:
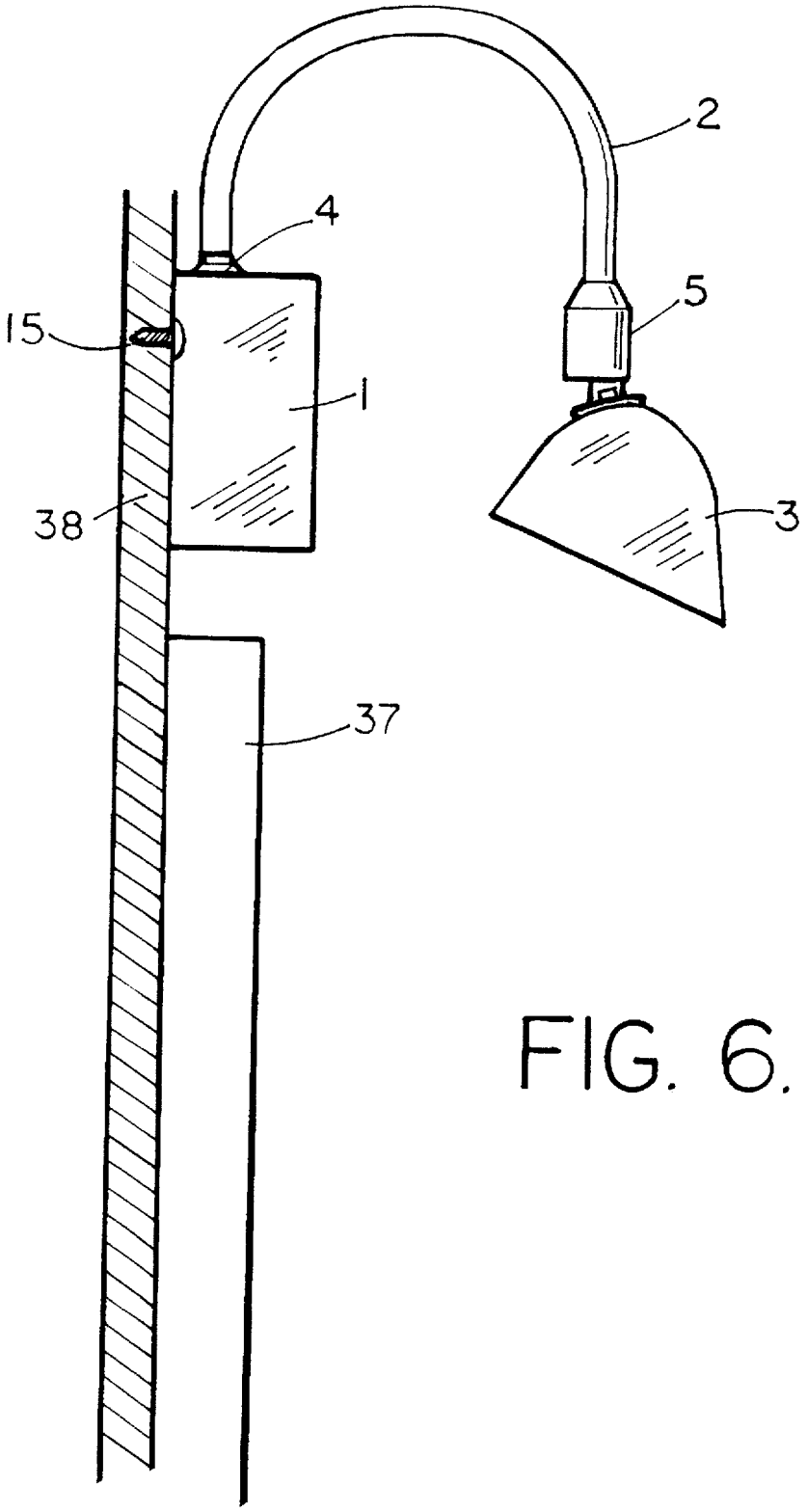
FIG. 6 is an side view of the picture lamp showing a method for mounting it to the wall.

Referring to FIG. 6, the invention is mounted to the wall 38, above the picture 37 by means of the screws 15, before the batteries 40 are placed into the inner casing 6.

From the foregoing description it should be apparent that the present invention provides many features that are entirely new in a battery operated, fluorescent picture lamp.

Obviously, the construction may be modified in some respects without departing from the spirit of the invention which is clearly spelled out in the claim.

What I claim is:

1. A wall mounted, cordless illuminating device comprising:

a tubular stem having a first end and a second end;

an elongated reflector having a midsection adjustably mounted to said first end of said tubular stem;

said reflector having a semicircular cross- sectional shape which defines an open front end and a curved back end;

an elongated bracket mounted on an inside surface of said curved back end; said elongated bracket having an electrical socket mounted on each end thereof for removably mounting at least one fluorescent light tube;

a generally box-shaped base secured to said second end of said tubular stem;

said box-shaped base having an uninterrupted, planar front face, and a planar back face for mounting flush against a vertical wall;

a means formed on said back face for mounting said box-shaped base to said vertical wall;

said generally box-shaped base further comprising;

an inside casing, said inside casing having a plurality of side walls, an open front end and a closed back end defining said back face;

said tubular stem being fixedly mounted to one of said side walls;

said one side wall of said inside casing further mounting a switch for controlling the electronic circuit;

a one-piece cover having a plurality of side walls, a back end defining an opening and a closed front end defining said front face;

said opening being dimensionally slightly larger than the plurality of side walls of the inside casing so that said cover is slidably received over said inside casing;

one side wall of said cover being formed with a plurality of open ended notches along one edge thereof;

a first one of said notches being dimensioned to receive said switch and a second one of said notches being dimensioned to receive said tubular stem; and means carried by said cover for securing said cover to said inside casing a source of direct current mounted within said box-shaped base;

an electronic circuit for converting direct current to alternating current mounted within said box-shaped base;

said electronic circuit includes conductors extending through said tubular stem and connected to said electrical sockets so as to energize the fluorescent light tube for illuminating said wall.

2. The wall mounted, cordless illuminating device of claim 1 wherein said means for mounting said box-shaped base comprises:

a plurality of mounting holes formed in said closed back end of said inside casing for allowing fasteners to pass therethrough in order to secure said planar back face flush against said vertical wall.

3. The wall mounted, cordless illuminating device of claim 1 wherein said means for securing said cover to said inside casing comprises a friction fit between the side walls of said inside casing and the side walls of said cover when said cover slides onto said inside casing.

4. The wall mounted, cordless illuminating device of claim 1 wherein said means for securing said cover to said inside casing comprises a resilient spring clip mounted within said cover adjacent said second notch whereby said spring will snap over said tubular stem when said cover slides onto said inside casing.

5. The wall mounted, cordless illuminating device of claim 1 wherein the generally box-shaped base further includes:

a generally rectangular shaped sheet of insulating material secured within said box-shaped base; and an electronic circuit card which carries said electronic circuit; said electronic circuit card being mounted on said sheet of insulating material and secured thereto.

6. The wall mounted, cordless, illuminating device of claim 5 wherein the source of direct current is a plurality of conventional direct current batteries.

7. The wall mounted, cordless, illuminating device of claim 6 wherein the generally box-shaped base further includes a battery holder made of molded insulating material for holding said plurality of conventional direct current batteries.

8. The wall mounted, cordless, illuminating device of claim 5 wherein the source of direct current is a plurality of rechargeable batteries.

9. The wall mounted, cordless, illuminating device of claim 8 wherein the generally box-shaped base further includes a battery holder made of molded insulating material for holding said plurality of rechargeable batteries.

10. The wall mounted, cordless, illuminating device of claim 5 wherein all but one of the external faces of said box-shaped base consists of uninterrupted planar surfaces to present an aesthetically appealing look.

11. The wall mounted, cordless, illuminating device of claim 5 wherein he tubular stem is adjustably mounted to the reflector by means of a universal tilt mechanism.

12. The wall mounted, cordless, illuminating device of claim 5 wherein the box-shaped base is generally rectangular with the long dimension thereof extending parallel to the top edge of a picture frame mounted on a wall.

13. The wall mounted, cordless, illuminating device of claim 1 wherein all but one of the external faces of said box-shaped base consists of uninterrupted planar surfaces to present an aesthetically appealing look.

14. The wall mounted, cordless, illuminating device of claim 1 wherein the box-shaped base is generally rectangular with the long dimension thereof extending parallel to the top edge of a picture frame mounted on a wall.

15. A wall mounted, cordless illuminating device comprising:

a tubular stem having a first end and a second end;

an elongated reflector having a midsection adjustably mounted to said first end of said tubular stem;

said reflector having a semicircular cross- sectional shape which defines an open front end and a curved back end;

an elongated bracket mounted on an inside surface of said curved back end; said elongated bracket having an electrical socket mounted on each end thereof for removably mounting at least one fluorescent light tube;

a generally box-shaped base secured to said second end of said tubular stem;

said box-shaped base having a plurality of external faces including an uninterrupted, planar front face, and a planar back face spaced from said front face for mounting flush against a vertical wall; the generally box-shaped base further comprises:

a hollow casing having an open front end and a closed back end defining said back face; and a cover removably secured to said casing at said open front end and defining said front face whereby said source of direct current housed within said generally box -shaped base may be removed and replaced;

a means formed on said back face for mounting said box-shaped base to said vertical wall;

a source of direct current mounted within said box-shaped base;

an electronic circuit for converting direct current to alternating current mounted within said box-shaped base;

said electronic circuit includes conductors extending through said tubular stem and connected to each said electrical socket so as to energize the fluorescent light tube for illuminating said wall.

* * * * *